US006866362B2

(12) United States Patent
Kimura et al.

(10) Patent No.: US 6,866,362 B2
(45) Date of Patent: Mar. 15, 2005

(54) INK JET RECORDING APPARATUS HAVING MAINTENANCE MEANS FOR CLEANING AN INK JET RECORDING HEAD

(75) Inventors: Kazuhisa Kimura, Hiratsuka (JP); Hideyuki Akaba, Kawasaki (JP); Hidekazu Ishii, Shizuoka (JP); Hideaki Nishida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/396,301

(22) Filed: Mar. 25, 2003

(65) Prior Publication Data

US 2004/0189741 A1 Sep. 30, 2004

(51) Int. Cl.[7] ..... B41J 2/165
(52) U.S. Cl. ..... 347/33
(58) Field of Search ..... 347/29, 23, 33, 347/32

(56) References Cited

U.S. PATENT DOCUMENTS

| | | | | |
|---|---|---|---|---|
| 4,380,770 A | | 4/1983 | Maruyama | |
| 5,126,765 A | | 6/1992 | Nakamura | |
| 5,231,424 A | | 7/1993 | Kaneko et al. | |
| 5,612,722 A | * | 3/1997 | Francis et al. | 347/33 |
| 5,953,025 A | * | 9/1999 | Sakurai | 347/33 |
| 6,000,792 A | | 12/1999 | Koizumi et al. | |
| 6,024,432 A | | 2/2000 | Aruga et al. | |
| 6,550,890 B2 | | 4/2003 | Saijo | |

FOREIGN PATENT DOCUMENTS

| | | |
|---|---|---|
| JP | 62-101448 A | 5/1987 |
| JP | 02-095862 A | 4/1990 |
| JP | 02-179757 A | 7/1990 |
| JP | 05-201014 A | 8/1993 |
| JP | 05-201028 A | 8/1993 |
| JP | 05-220970 A | 8/1993 |
| JP | 06-071904 A | 3/1994 |
| JP | 06-135004 A | 5/1994 |
| JP | 09-076517 A | 3/1997 |
| JP | 10-119311 A | 5/1998 |
| JP | 2000-127417 A | 5/2000 |
| JP | 2000-177113 A | 6/2000 |
| JP | 2000-280494 A | 10/2000 |
| JP | 3161050 B2 | 2/2001 |
| JP | 2001-219567 A | 8/2001 |
| JP | 2001-260368 A | 9/2001 |
| JP | 2002-283590 A | 10/2002 |

OTHER PUBLICATIONS

Related U.S. Appl. No. 10/396,307, filed Mar. 26, 2003; Inventors: Kazuhisa Kimura et al; Title: An Ink Jet Recording Apparatus Having Cleaning Means for the Cleaning of the Nozzle Surface of an Ink Jet Head.

(List continued on next page.)

*Primary Examiner*—Shih-Wen Hsieh
(74) *Attorney, Agent, or Firm*—Frishauf, Holtz, Goodman & Chick, P.C.

(57) ABSTRACT

A mechanism is provided for allowing a wipe member formed of an elastic material to abut against a nozzle plate in which a plurality nozzles communicating with a pressure chamber for holding ink therein are arranged, moving the wipe member along the nozzle plate to remove ink and foreign particles remaining in the nozzle plate, and switching the position of abutment of the wipe member against the nozzle plate, whereby satisfactory sweeping capability of the wipe member can be maintained without providing a wipe member cleaning mechanism and performing the work of replacing of the wipe member with another.

12 Claims, 12 Drawing Sheets

OTHER PUBLICATIONS

Related U.S. Appl. No. 10/403,091, filed Apr. 1, 2003; Inventor: Kazuhisa Kimura; Title: Image Recording Apparatus and Maintenance Method of Recording Head of the Same.

Related U.S. Appl. No. 10/395,960, filed Mar. 24, 2003; Inventor: Hidekazu Ishii et al.; Title: Ink Jet Head Cleaning Apparatus and Ink Jet Recording Apparatus, pending.

Related U.S. Appl. No. 10/465,112, filed Jun. 19, 2003; Inventor: Hideaki Nishida et al.; Title: Ink Jet Head Cleaning Apparatus and Ink Jet Recording Apparatus, pending.

Related U.S. Appl. No. Serial No. 10/716,899, filed Nov. 18, 2003; Inventor: Kazuhisa Kimura et al.; Title: Ink Jet Recording Head Maintenance Apparatus and Ink Jet Recording Apparatus, pending.

* cited by examiner

INK JET RECORDING APPARATUS HAVING MAINTENANCE MEANS FOR CLEANING AN INK JET RECORDING HEAD

BACKGROUND OF THE INVENTION

1. Field of the Invention

The present invention relates to a maintenance means for cleaning an ink jet recording head, and particularly to a maintenance means for cleaning an ink jet recording head which delivers ink droplets through nozzles provided in a board-shaped nozzle plate, and an ink jet recording apparatus having the same.

2. Description of the Background Art

There has been known an ink jet recording apparatus which selectively delivers ink droplets to a recording medium through a plurality of nozzles arranged in a nozzle plate.

In the ink jet recording apparatus, ink might remain around the nozzles after the delivery of the ink droplets. Drying/curing such remaining ink could lead to turning of the direction of ink delivery, clogging of the nozzles, etc. upon subsequent printing. Thus it becomes apt to produce a failure in ink delivery and a failure in print. Foreign particles like dirt of the recording medium, and dust in the air are adhered to the peripheries of the nozzles, thus leading to turning of the direction of ink delivery and clogging of the nozzles. Thus it becomes apt to produce a failure in ink delivery and a failure in print.

Therefore, there have heretofore been proposed various ink jet recording apparatuses which remove ink and foreign particles remaining around nozzles.

There is known, for example, a technology wherein a wipe member formed of an elastic body or the like is pressed against a nozzle plate and slid along the nozzle plate in this condition to thereby sweep foreign particles adhered to the nozzle plate.

In order to prevent degradation of sweeping capability due to the adhesion of the foreign particles removed from the nozzle plate by sweeping to the wipe member, there is also known, for example, a technology provided with a cleaning means for cleaning the wipe member in addition to the aforementioned technology.

However, the foreign particles adhered to the wipe member cannot be removed perfectly even in the case of execution of its cleaning. Therefore, the prior art is not capable of enhancing sweeping capability despite the fact that cleaning has been effected on the wipe member. Further, a failure in print might occur with the transfer of the foreign particles adhered to the wipe member to nozzle surfaces even after its cleaning. Such degradation of the sweeping capability remarkably appears as abrasion of the wipe member makes progress.

As a countermeasure against it, there has heretofore been known a maintenance means for cleaning an ink jet recording head, which makes a wipe member detachable and is capable of replacing a worn wipe member with another wipe member.

In such a maintenance means for cleaning the ink jet recording head, however, a problem also arises in that, for example, the work of replacing the wipe member with another is complex and the hands get dirty upon its replacement work.

SUMMARY OF THE INVENTION

Thus, an object of the present invention is to maintain satisfactory sweeping capability of a wipe member without providing a cleaning means for the wipe member and performing the work of replacing the wipe member.

Another object of the present invention is to enhance sweeping capability of a wipe member without complicating its configuration.

A further object of the present invention is to maintain satisfactory sweeping capability of a wipe member over a long period.

A still further object of the present invention is to maintain satisfactory delivery performance at print.

A still further object of the present invention is to maintain satisfactory delivery performance at print over a long period.

A still further object of the present invention is to maintain satisfactory delivery performance at print and enhance reliability at print.

Those objects of the present invention are achieved by a novel maintenance means for cleaning an ink jet recording head, of the present invention and an ink jet recording apparatus having the same.

Thus, according to the novel maintenance means for cleaning the ink jet recording head, of the present invention, a wipe member is abutted against a nozzle plate and moved along the nozzle plate to thereby perform switching of the position of abutment of the wipe member for removing ink and foreign particles remaining in the nozzle plate against the nozzle plate.

According to the novel ink jet recording apparatus of the present invention, a wipe member abutted against a nozzle plate formed with a plurality of nozzles communicating with a pressure chamber for holding ink therein is moved along the nozzle plate to thereby remove ink and foreign particles remaining the nozzle plate and perform switching of the position of abutment of the wipe member against the nozzle plate.

BRIEF DESCRIPTION OF THE DRAWINGS

More complete understanding of the present invention and many advantages accompanying the present invention is easily obtained with better understanding by reference to the following detailed description when taken into consideration in connection with the accompanying drawings in which.

DETAILED DESCRIPTION OF THE PREFERRED EMBODIMENTS

Preferred embodiments of the present invention will be described with reference to the accompanying drawings.

Figure 1:
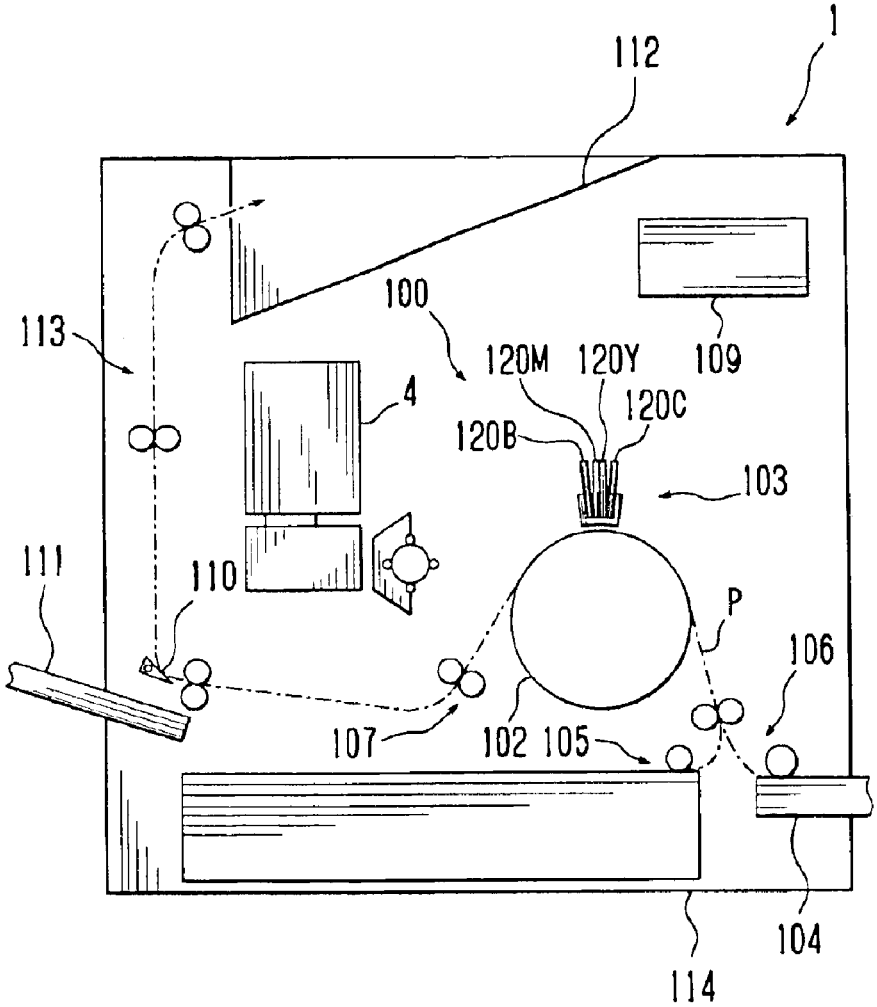
FIG. 1 is a longitudinal sectional view schematically showing an ink jet recording apparatus 1 of one embodiment of the present invention.

FIG. 1 schematically shows an ink jet recording apparatus 1 according to one embodiment of the present invention. The ink jet recording apparatus 1 according to the present embodiment effects color printing on paper corresponding to a recording medium. As the paper, may be used, for example, a plain paper, a coated paper, an OHP sheet, etc.

A paper path P extending from a manual feed tray 104 or a paper cassette 105 to a paper delivery tray 111 or a paper delivery tray 112 through a print section 100 comprising a drum 102 and a print unit 103 is provided within a casing 114 of the ink jet recording apparatus 1. A paper feed mechanism 106 for separating one by one sheets stacked in the manual feed tray 104 and the paper cassette 105 and feeding it to the paper path P is provided for the manual tray 104 and the paper cassette 105.

A paper conveying mechanism 113 for conveying paper from the manual tray 104 or the paper cassette 105 to a paper delivery mechanism 107 along the paper path P, and the paper delivery mechanism 107 for delivering paper to which printing is made in the print section 100, are provided in the paper path P.

The print section 100 performs printing based on print data by means of the print unit 103 while being rotated at a predetermined speed in a state of bearing paper on the outer periphery of the drum 102.

The print unit 103 includes four nozzle units 120C (Cyan), 120Y (Yellow), 120M (Magenta) and 120B (Black). The nozzle units 120C, 120Y, 120M and 120B are respectively provided with a plurality of the ink jet heads 2 to be described later. In the present embodiment, the print unit 103 is disposed on the upper side of the drum 102 in such a manner that nozzles included in the ink jet heads 2 to be described later are opposed to the drum 102 from above. When the paper feed mechanism 104 side and the paper delivery mechanism 107 side are respectively set as the upstream side and the downstream side in the paper path P, the respective nozzle units 120C, 120Y, 120M and 120B are disposed in an arrangement of 120C (Cyan), 120Y (Yellow), 120M (Magenta) and 120B (Black) in order from the upstream side. The respective nozzle units 120C, 120Y, 120M and 120B are disposed such that the plurality of ink jet heads extend in an X-axis direction of the drum. The respective nozzle units 120C, 120Y, 120M and 120B are arranged in such a manner that the direction of an arrangement of the nozzles included in the ink jet heads 2 to be described later extends parallel to the direction of an axial center of the drum 102.

The ink jet recording apparatus 1 is equipped with an ink supply mechanism 4 for supplying ink to the ink jet heads 2 (see FIG. 2) provided in the print unit 103. The ink supply mechanism 4 supplies ink of corresponding colors to the nozzle units 120C, 120Y, 120M and 120B respectively.

Figure 5:
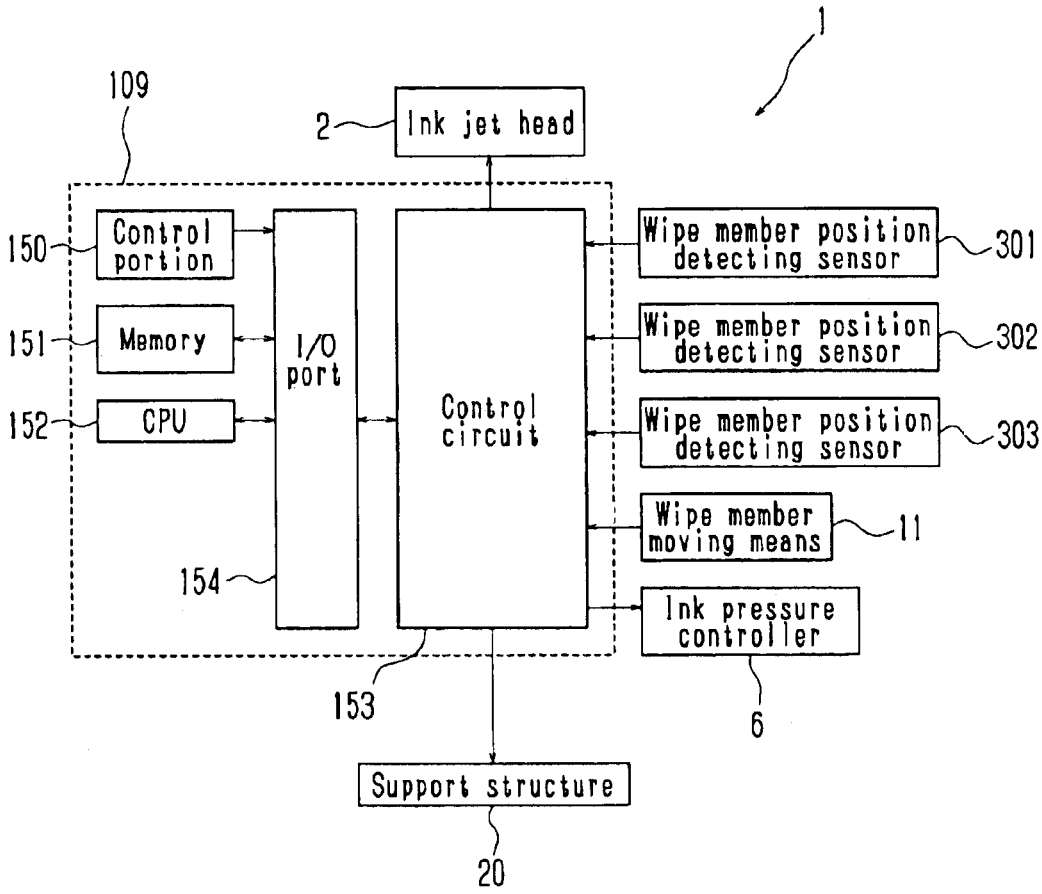
FIG. 5 is a block diagram showing electrical connections between respective portions with which the ink jet recording apparatus of the present invention is equipped.
Figure 11:
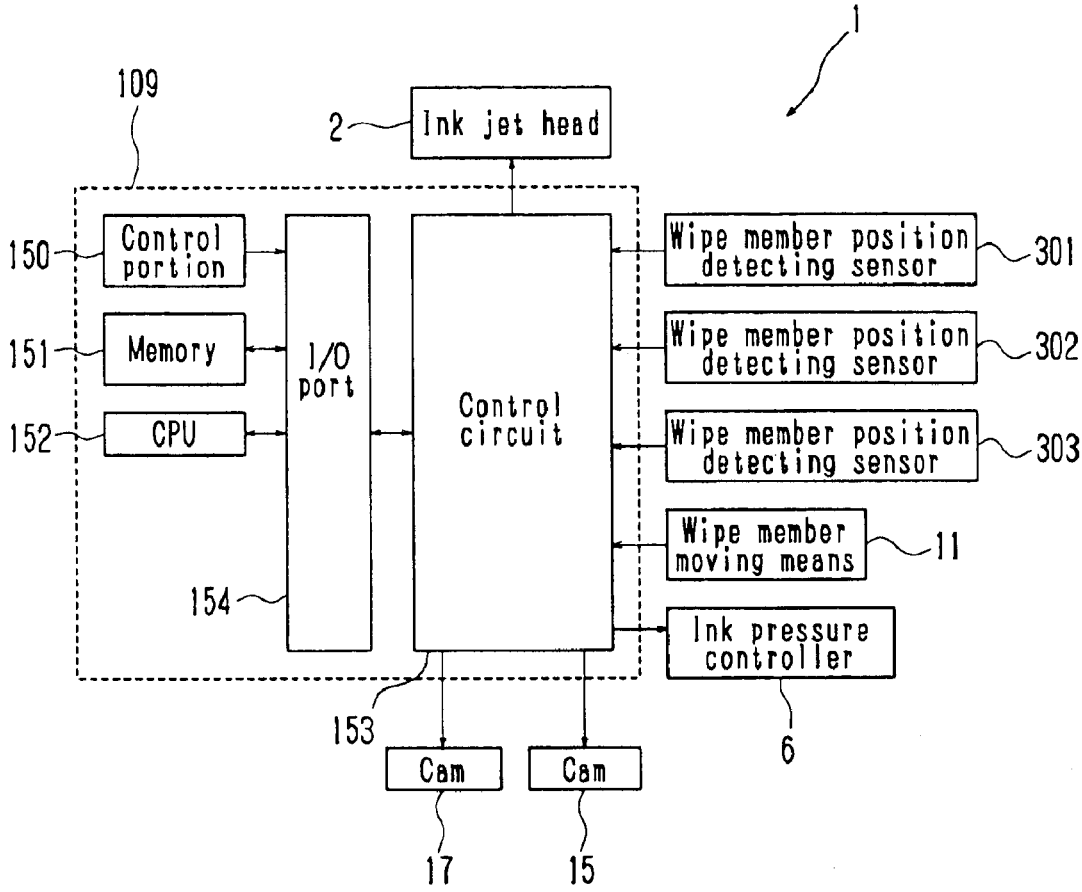
FIG. 11 is a block diagram showing electrical connections between respective portions with which another ink jet recording apparatus of the present invention is equipped.

Further, the ink jet recording apparatus 1 is provided with a controller 109 for generally controlling respective portions that the ink jet recording apparatus 1 has (see FIGS. 5 and 11).

Figure 2:
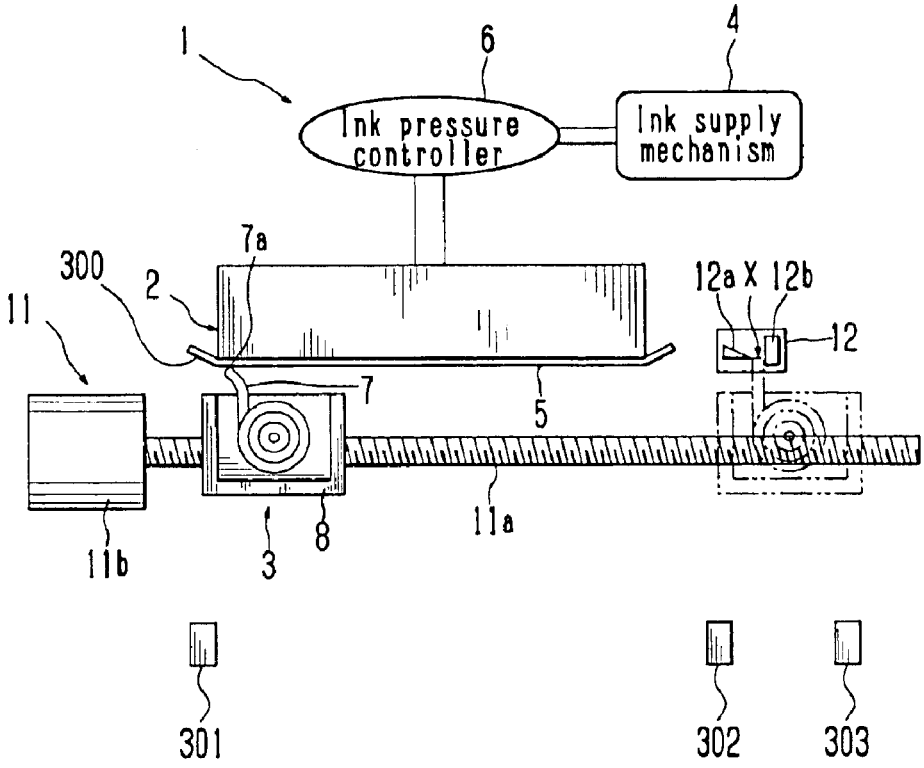
FIG. 2 is a schematic diagram illustrating an ink jet recording apparatus having a maintenance means for cleaning an ink jet recording head, according to the present invention.

FIG. 2 is a schematic diagram illustrating an ink jet recording apparatus of the present invention. The ink jet recording apparatus 1 includes an ink jet recording head 2 for delivering ink to an unillustrated recording medium, and maintenance means 3 for cleaning an ink jet recording head 2.

Although the description of the ink jet recording head 2 is omitted because of the known technology, the ink jet recording head 2 is provided with a plurality of pressure chambers for holding ink supplied by the ink supply mechanism 4 and performs printing according to changes in volumes of the pressure chambers.

Each pressure chamber of the ink jet recording head 2 is formed by grooves defined in a substrate and for opening front and top face sides, a top plate for blocking the top face of each groove, and a nozzle plate 5 for blocking the front face of each groove.

The substrate formed with the grooves is formed by bonding two piezoelectric members polarized in a board-thickness direction in such a manner that their polarized directions are opposite to each other. The grooves are formed by processing the substrate along a laminated direction of the piezoelectric members. The respective grooves are respectively partitioned in parallel by side walls placed between the respective grooves. An electrode is formed in an inner surface of each groove. The electrode can be formed using an electroless nickel plating method, for example. The substrate is provided with wiring patterns provided in continuation with the electrode.

The top plate is formed with a common ink chamber which communicates with the respective pressure chambers, and an ink supply port for supplying ink to the common ink chamber. The ink supply mechanism 4 supplies ink stored or held in an ink tank to the ink supply port.

In the present embodiment, a liquid type ink such as aqueous, oil, or ultra-violet cured one is used. The ink employed in the present embodiment contains pigment or dye or the like as a color material.

The nozzle plate 5 is formed with a plurality of nozzles 10 (see FIG. 3) which extend therethrough in its plate-thickness direction. The respective nozzles 10 are respectively provided in association with the respective pressure chambers. Thus, the respective pressure chambers and the outside are caused to communicate through the nozzles 10. The nozzle plate 5 is provided with an ink repellent layer having an ink repellent characteristic for repelling ink. The ink repellent layer includes peripheral surfaces of the nozzles 10 and is provided over the whole surface of the nozzle plate 5. It is thus possible to stabilize a delivery direct-advance property of ink droplets.

The ink jet head 2 is provided with a protective member 300 for protecting the nozzle plate 5 outside the nozzle plate 5. The provision of the protective member 300 prevents the inability to maintain the basic characteristic of the head due to the occurrence of flaws and breakage in the nozzle plate 5. The protective member 300 is capable of preventing the occurrence of damage such as flaws in the nozzle plate 5 upon adjusting a gap between a print surface (paper) and the ink jet head 2. The protective member 300 is capable of fulfilling the function of protecting the nozzle plate 5 even against an external force that has the potential of being applied to the nozzle plate 5 upon transportation of the ink jet head 2, for example.

The ink supply mechanism 4 is equipped with an ink tank for holding ink therein, a filter for removing foreign particles contained in the ink held in the ink tank, etc.

The ink supplied by the ink supply mechanism 4 is controlled in its supply pressure by an ink pressure controller 6. The ink pressure controller 6 adjusts pressure of ink supplied to the ink jet recording head 2 with respect to the entirety of the ink jet recording head 2. It is thus possible to adjust the position of an ink level at each nozzle 10.

The maintenance means 3 includes a wipe member 7 formed of an elastic material and a wipe support member 8 which supports the wipe member 7 and is movable in a nozzle arrangement direction along the nozzle plate 5.

The wipe member 7 is shaped in a long form and wound in a roll fashion. A tip of the wipe member 7 serves as a wipe portion abutted against the nozzle plate. The wipe portion is provided with an edge portion 7*a* extending along the direction intersecting the direction of movement of the wipe support member 8. The wipe member 7 can be formed of a rubber member such as acrylonitrile-butadiene rubber (NBR), fluorine rubber (FPM) or the like.

The wipe support member 8 includes a support structure 20 (see FIG. 5) for rotatably supporting the wipe member 7 about a winding axial center thereof at a fixed position in the wipe support member 8. The support structure 20 has a construction capable of making it possible to rotate the wipe member 7 and fixing its rotation. Here, such a mechanism as to support the wipe member 7 is realized by the wipe support member 8. Incidentally, various known technologies can be applied to the support structure 20 for rotatably and fixably holding a roll-shaped object, and the description thereof will be omitted herein. The wipe support member 8 normally supports the wipe member 7 in a state in which the rotation of the wipe member 7 is being fixed. The state in which the wipe support member 8 has fixed the rotation of the wipe member 7 in this way, will be subsequently defined as a fixed support state. In the present embodiment, such a state that the tip of the wipe member 7 is brought into contact with or abutted against the nozzle plate 5 in the fixed support state, is defined as an abutted support state. This will be described in distinction from the simple fixed support state.

Although the wipe support member 8 is provided so as to be capable of moving forward and backward alternately along the direction of the arrangement of the nozzles 10 as will be described later, the wipe support member 8 is on standby at home position except for the execution of a maintenance operation to be described later. The home position of the wipe support member 8 may be a position where the tip of the wipe member 7 is not brought into contact with the nozzle plate 5.

Figure 3A:
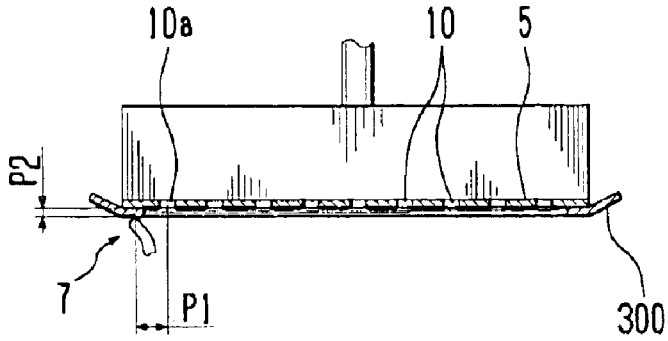
FIG. 3A is a side view which describes a home position of a wipe support member and shows part of an ink jet head in section.
Figure 3B:
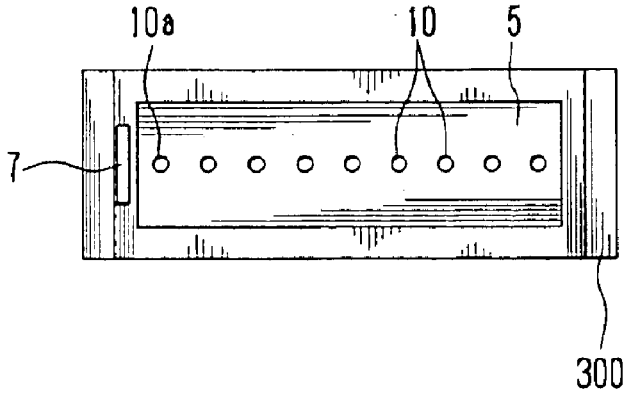
FIG. 3B is an explanatory view which illustrates the home position of the wipe support member and shows a state of the ink jet head as seen from the nozzle side.

As shown in FIGS. 3A and 3B, for example, such a position that even though the wipe member 7 per se is located in a position opposite to the nozzle plate 5, the tip thereof is withdrawn from the nozzle plate 5 to be brought into contact with the protective member 300, may be defined as the home position of the wipe member 7. At this time, the wipe member 7 is brought into contact with the protective member 300 more outside the nozzle 10*a* used as an outermost portion as viewed in the direction of the arrangement of the nozzles 10. In FIG. 3A, the distance as viewed in the direction of the arrangement of the nozzles 10 from the nozzle 10*a* to the position where the wipe member 7 and the protective member 300 are brought into contact with each other, is expressed by P1, and the distance as viewed in the ink delivery direction from the nozzle plate 5 to the tip of the wipe member 7 is expressed by P2.

Figure 4A:
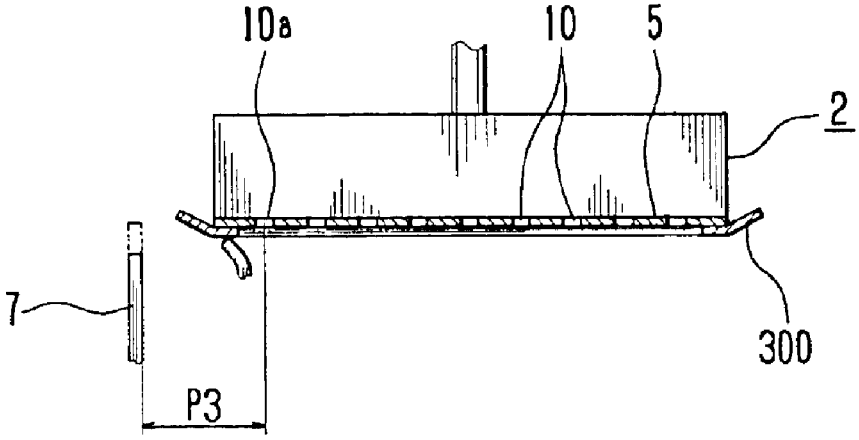
FIG. 4A is a side view which explains another home position of the wipe support member and shows part of the ink jet head in section.
Figure 4B:
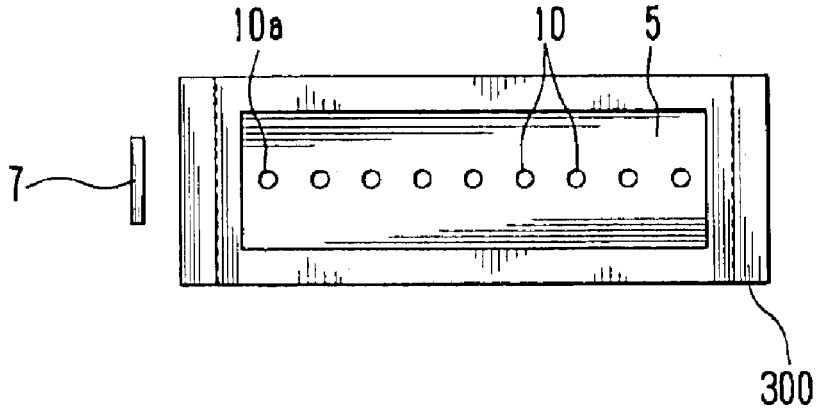
FIG. 4B is an explanatory view which illustrates another home position of the wipe support member and shows a state of the ink jet head as seen from the nozzle side.

The home position of the wipe support member 8 may be set to a position which is located more outside a nozzle 10*a* used as an outermost portion as viewed in the direction of an arrangement of nozzles 10 and which is opposite to a nozzle plate 5 as shown in FIGS. 4A and 4B, for example. In FIG. 4A, the distance as viewed in the direction of the arrangement of the nozzles 10 from the position of support of a wipe member 7 by the wipe support member 8 to the wipe member 7 is expressed by P3. The distance P3 is set longer than the length from the nozzle 10*a* to the other end of a protective member 300 as viewed in the direction of the arrangement of the nozzles 10.

The ink jet recording apparatus 1 is equipped with a wipe member home position sensor 301 whose output changes according to whether the wipe support member 8 is located in its home position.

Meanwhile, the wipe member 7 is movable forward and backward alternately in a vertical direction as seen on the paper in FIG. 2 by the support structure 20. Upon execution of the maintenance operation to be described later, the wipe member 7 is abutted against the nozzle plate 5 only in the case where it moves in one direction (from the left to right direction in FIG. 2) toward the direction in which the wipe member is separated from its home position. The direction in which the wipe member proceeds from the home position to the right side in FIG. 2, is subsequently defined as a sweep direction.

When the position shown in FIGS. 4A and 4B is assumed to be the home position of the wipe support member 8, the wipe support member 8 may be located in a position indicated by a solid line in FIG. 4A or may be located in a position indicated by a dotted line in FIG. 4A. In the present embodiment, the position indicated by the solid line in FIG. 4A is defined as the home position of the wipe support member 8.

Figure 7:
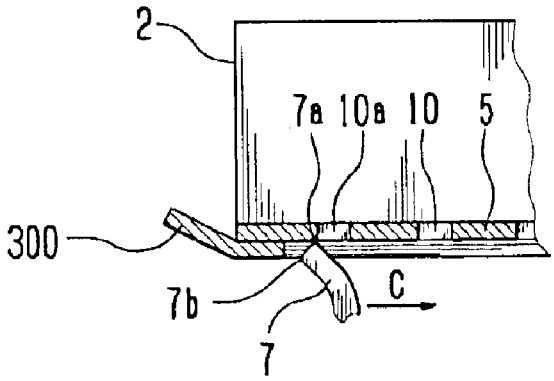
FIG. 7 is an explanatory view showing a state in which a wipe member is abutted against a nozzle plate in an abutted support state.

In an abutted support state, the wipe support member 8 supports the wipe member 7 so as to press an edge portion 7*a* against the nozzle plate 5 (see FIG. 7). The wipe support member 8 placed in the press support state elastically bends the tip of the wipe member 7 and urges the edge portion 7*a* toward the nozzle plate 5 under an elastic force of the wipe member 7 itself. The wipe member 7 is bent in such a manner that its tip is placed on the rear side with respect to the progress side (direction indicated by arrow c in FIG. 7) corresponding to the direction in which the wipe support member 8 is first moved when the wipe support member 8 is moved in a reciprocating manner by wipe member moving means 11 to be described later.

The wipe support member 8 employed in the present embodiment serves as a cartridge and is provided detachably from a main body of the apparatus together with the wipe member 7. The wipe member 7 is supported detachably with respect to the wipe support member 8 and can be replaced with respect to the wipe support member 8.

The wipe support member 8 is movable along the direction of the arrangement of the nozzles 10 by the wipe member moving means 11. While the description of a mechanism for moving the wipe support member 8 in the reciprocating manner is omitted because of the known technology, it can be realized by, for example, a shaft 11*a* extended out in the moving direction of the wipe support member 8, and a drive source 11*b* such as a motor for reciprocating the wipe support member along the shaft. Here, the wipe member moving means 11 realizes a mechanism 11 for moving the mechanism 8 for supporting the wipe member 7 along the nozzles 10.

The wipe member moving means 11 is driven upon the maintenance operation to be described later and reciprocates the wipe support member 8 along the direction (sweep direction) of the arrangement of the nozzles 10. Upon execution of the maintenance operation to be described later, the wipe member moving means 11 moves the wipe support member 8 in the sweep direction in a state in which the edge portion 7*a* of the wipe member 7 is abutted against the nozzle plate 5.

A wipe member end position sensor 302 whose output changes depending on the presence or absence of the wipe support member 8 is provided at a return position of the movement of the wipe support member 8 in the sweep direction. The wipe member moving means 11 restores the wipe support member 8 to its home position according to a change in the output of the wipe member end position sensor 302 upon execution of the maintenance operation to be described later. At this time, the support structure 20 is driven upon restoring of the wipe support member 8 to the home position to separate the tip of the wipe member 7 and the nozzle plate 5 from each other upon returning of the wipe support member 8 to the home position. When the wipe member 7 wound in the roll form is used as in the present embodiment, the wipe member 7 and the nozzle plate 5 can be spaced away from each other by rotating the wipe member 7 in its winding direction. Even in addition to it, however, there is considered, for example, a method of moving the wipe support member 8 per se downward to thereby separate the tip of the wipe member 7 and the nozzle plate 5 from each other.

Incidentally, while in the present embodiment, the timing for restoring the wipe support member 8 to the home position is determined, based on the change in the output from the wipe member end position sensor 302 is provided in the present embodiment, no limitation is imposed on it. The timing for restoring the wipe support member 8 to the home position may be determined by managing the distance of motion of the wipe support member 8 with respect to the distance as viewed in the direction of the arrangement of the nozzles 10.

The maintenance means 3 is provided with a wipe member cutting mechanism 12 for cutting the tip of the wipe member 7. The wipe member cutting mechanism 12 includes a blade portion 12*a* used to cut the wipe member 7, and a receiving table 12*b* for supporting the wipe member 7 upon its cutting. The blade portion 12*a* is provided reciprocatingly in the direction to approach the receiving table 12*b* and detach therefrom. Upon cutting of the wipe member 7, the blade portion 12*a* is displaced in the direction to approach the receiving table 12*b* to thereby bring its tip into contact with the receiving table 12*b*. A moving trajectory of the blade portion 12*a* at this time is defined as a cut position X (indicated by a broken line in FIG. 2). The cut position X falls within a moving range of the wipe support member 8 as viewed in the moving direction of the wipe support member 8 and is provided at a position where the wipe member 7 is not abutted against the nozzle plate 5. Incidentally, the blade portion 12*a* is provided on the ink jet recording head 2 side rather than on the receiving table 12*b* side, in order to cut the wipe member 7 upon moving in the sweep direction.

The ink jet recording apparatus 1 is provided with a wipe member cut position detecting sensor 303 whose output changes according to the presence or absence of the wipe member support member 8 at such a position of the wipe support member 8 as to locate the wipe member 7 in the cut position X as viewed in the moving direction of the wipe support member 8. Upon execution of a switching operation to be described later, the timing provided to bring out the wipe member 7 is measured according to the presence or absence of the change in the output from the wipe member cut position detecting sensor 303.

Incidentally, while the time provided to bring out the wipe member 7 is measured according to the presence or absence of the change in the output from the wipe member cut position detecting sensor 303 in the present embodiment, the present invention is not limited to it. The timing provided to bring out the wipe member 7 may be measured by managing the distance of movement of the wipe support member 8 with respect to the distance as viewed in the direction of the arrangement of the nozzles 10.

The wipe member home position sensor 301, the wipe member end position sensor 302 and the wipe member cut position detecting sensor 303 can respectively be realized by, for example, a photointerruptor or the like and are respectively configured so as to receive light emitted from a light-emitting element by means of a light-receiving element. The light-emitting element and the light-receiving element are placed in an opposing relation with a moving trajectory of the wipe support member 8 being interposed therebetween, and their outputs change according to the presence or absence of passage of the wipe support member 8 between the light-emitting element and the light-receiving element.

The ink jet recording apparatus 1 has a control portion 150 in which various control keys or the like which accept operations made by an operator, are arranged (see FIG. 5).

Here, FIG. 5 is a block diagram showing electrical connections between respective portions with which the ink jet recording apparatus 1 is equipped. The ink jet recording apparatus 1 has the controller 109 for driving and controlling the respective portions included in the ink jet recording apparatus 1. The controller 109 is configured by connecting a CPU 152 for executing various control programs to thereby drive and control the respective portions included in the ink jet recording apparatus 1, a ROM for storing the various control programs therein, a memory 151 which serves as a work area of the CPU, etc. via an I/O port 154.

The wipe member home position sensor 301, wipe member end position sensor 302, and wipe member cut position detecting sensor 303 are connected to the I/O port 154 through a control circuit 153.

The aforementioned ink pressure controller 6, wipe moving means 11, support structure 20 and ink jet head 2 are additionally connected to the control circuit 153.

The controller 109 drives and controls the respective portions included in the ink jet recording apparatus 1 to thereby execute a print operation and a maintenance operation. The controller 109 performs the maintenance operation or the like, based on a signal outputted from the control portion 150 according to each key operation of the operator, for example.

An area for storing various data or the like to which references are made upon execution of a maintenance operation and a switching operation to be described later, is ensured in the memory 151. For instance, the number of maintenance executions cumulated from the execution of the previous maintenance operation, and data about a maintenance non-execution time or the like counted since the execution of the previous maintenance are stored in the present area. Ascending data and descending data to which references are made upon upward and downward operations of the tip of the wipe member 7 by the support structure 20 and which are related to displacements, etc. are stored in the area. In addition to it, various counter areas used upon execution of the maintenance operation and the switching operation to be described later are ensured in the memory 151.

In such an ink jet recording apparatus 1, a voltage is applied to an electrode corresponding to a pressure chamber intended for delivery of ink, based on print data upon a print operation. Thus, a pair of side walls in the pressure chamber to which the voltage is applied, is deformed so as to temporarily expand the volume of the pressure chamber and shrink it. With such a change in the volume of the pressure chamber, some of the ink absorbed into the pressure chamber are delivered from each nozzle 10 as ink droplets.

On the other hand, the ink might remain around the nozzles 10 which have delivered the ink therethrough, upon such a print operation. Since such remaining ink flexes the direction of delivery of the ink and clogs up the nozzles 10 when dried/cured, to thereby lead to the occurrence of a failure in the delivery of the ink, there is a need to remove the remaining ink.

The ink jet recording apparatus 1 according to the present embodiment removes ink and foreign particles remaining in the nozzle plate 5 according to the maintenance operation made by the maintenance means 3. The maintenance operation made by the maintenance means 3 will be explained below.

The maintenance means 3 is on standby until the execution of the maintenance operation is declared. When it determines that the execution of the maintenance operation has been declared, the maintenance means 3 is driven and controlled by the controller 109 to perform the maintenance operation.

Here, the maintenance operation is carried out where the execution of the maintenance operation is declared by an operator's key operation or the like, for example.

When it is determined that the execution of the maintenance operation has been declared (Y in Step S1) during standby of the declaration of the execution of the maintenance operation (N in Step S1), the support structure 20 is driven to rotate the wipe member 7 and elevate the wipe support member 8 (Step S2) until it is determined based on the ascending data stored in the memory 151 that the wipe support member 8 has ascended up to its upper limit (N in Step S3).

When it is determined based on the ascending data stored in the memory that the wipe support member 8 has ascended up to its upper limit (Y in Step S3), the wipe member moving means 11 is driven and controlled (Step S4). to move the wipe support member 8 from the left to the right in FIG. 2 until it is determined based on the change in the output from the wipe member end position sensor 302 that the wipe support member 8 has reached its end position (N in Step S5). Thus, the tip of the wipe member 7 is abutted against the nozzle plate 5 as shown in FIG. 7. In such a state, the wipe support member 8 is moved in the sweep direction to thereby make it possible to move the wipe member 7 so as to rub against the nozzle plate 5. Consequently, the ink and foreign particles remaining around the nozzles 10 can be swept away from the nozzle plate 5.

Even if the wipe member 7 is moved in a state in which the edge portion 7*a* of the wipe member 7 has been pressed against the nozzle plate 5, no nozzle plate 5 is flawed owing to the formation of the wipe member 7 by the elastic material.

When it is determined based on the change in the output from the wipe member end position sensor 302 that the wipe support member 8 has reached its end position. (Y in Step S5), the driving of the wipe member moving means 11 is stopped (Step S6), and the up-down mechanism is driven to move the wipe support member 8 downward (Step S7) until it is determined based on the descending data stored in the memory that the wipe support member 8 has descended to its lower limit (N in Step S8).

Then the wipe member moving means 11 is driven in a reverse direction (Step S9) until it is determined based on the change in the output from the wipe member home position sensor 301 that the wipe support member 8 has been moved to its home position (N in Step S10).

When it is determined based on the change in the output from the wipe member home position sensor 301 that the wipe support member 8 has been moved to the home position (Y in Step S10), the driving of the wipe member moving means 11 is stopped (Step S11) and a counter provided for the memory is incremented (Step S12). It is then determined whether the incremented count has reached the preset number of times that maintenance is performed (Step S13).

Figure 6:
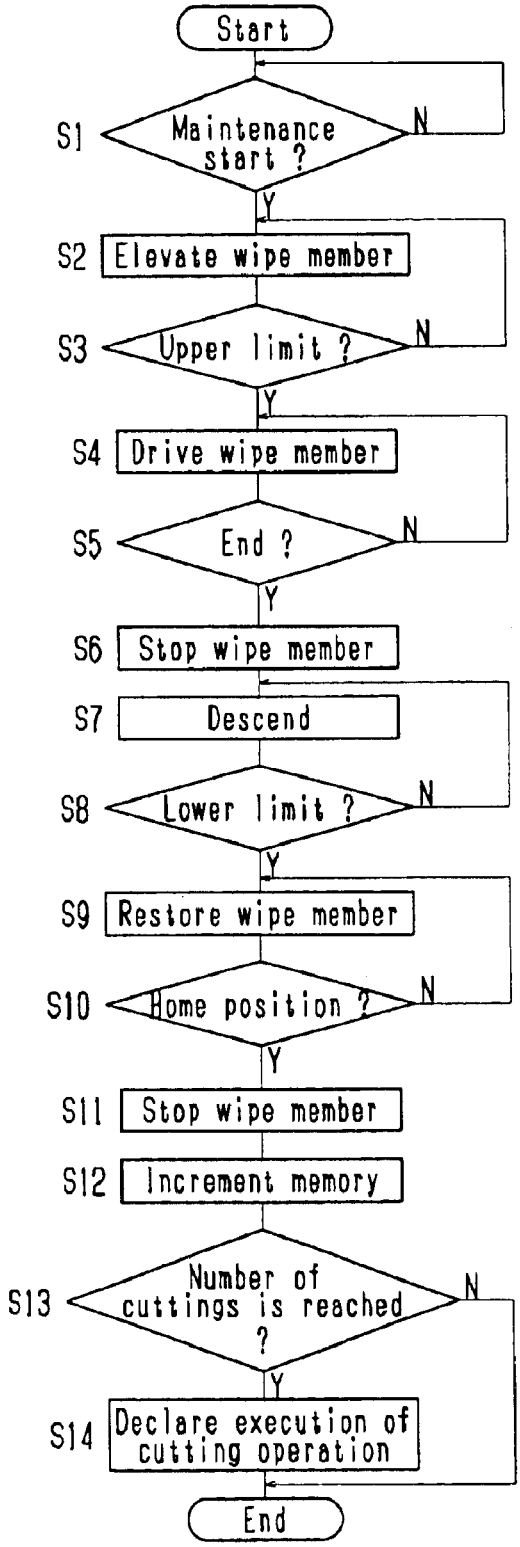
FIG. 6 is a flowchart for schematically describing a maintenance operation for the ink jet recording apparatus of the present invention.

When it is determined that the incremented count does not reach the preset number of times that the maintenance is performed (N in Step S13), the processing is completed as it is. When it is determined that the incremented count has reached the preset number of times that the maintenance is executed (Y in Step S13), execution of a switching operation to be described later is declared (Step S14). The above operation flowchart was shown in FIG. 6.

Meanwhile, the ink and foreign particles removed from the nozzle plate 5 by sweeping are adhered to the wipe member 7 and increase with repetition of the maintenance operation. When the foreign particles adhered to the wipe member 7 increase, sweeping capability is degraded and the foreign particles are transferred to the nozzle plate 5, whereby a print failure might be brought about. Such degradation of the sweeping capability is brought to the fore as abrasion of the wipe member 7 makes progress.

In the present embodiment on the other hand, the capability of sweeping by the maintenance means 3 can be maintained by carrying out a switching operation to be described later. The switching operation of the maintenance means 3 will be described below.

The maintenance means 3 is on standby until the execution of the switching operation is declared. When it determines that the execution of the switching operation has been declared, the maintenance means 3 is driven and controlled by the controller 109 to perform the switching operation.

The switching operation is executed with timing at which a predetermined number of maintenance operations are performed, timing at which no maintenance operation is executed, or timing at which execution is instructed by an operator's key operation or the like. In the present embodiment, the execution of a cutting operation is declared upon the above-described maintenance operation where the predetermined number of maintenance operations are performed. Therefore, the cutting operation is executed with timing at which the execution of the cutting operation is declared. Although not illustrated in particular, the ink jet recording apparatus 1 according to the present embodiment takes such a configuration as to count a time elapsed since the completion of the maintenance operation for each completion of the aforementioned maintenance operation and declare the execution of the cutting operation where the counted time is over a predetermined time. Incidentally, when a print operation or a maintenance operation is newly executed before the elapse of a predetermined time, the counted elapsed time is cleared.

When it is determined that the execution of the switching operation has been declared due to the aforementioned various factors (Y in Step S20, Y in Step S21 or Y in Step S22) during standby of the declaration of execution of the switching operation (N in Step S20, N in Step S21 and N in Step S22), the wipe member moving means 11 moves the wipe member in a cut position X direction (Step S23) until it is determined based on an output value from the wipe member cut position detecting sensor 303 that the wipe support member 8 has been moved to the cut position X (N in Step S24).

When it is determined based on the output value from the wipe member cut position detecting sensor 303 that the wipe support member 8 has been moved to the cut position X (Y in Step S24), the wipe member moving means 11 is stopped (Step S25), and the support structure 20 is driven to rotate the wipe member 7, thereby paying or bringing out the wipe member 7 to such an extent that the tip of the wipe member 7 extends beyond the cut position X by the wipe member cutting mechanism 12 (Step S26).

In this condition, the blade portion 12*a* is driven to cut a leading portion of the wipe member 7 paid out beyond the cut position X (Step S27). Here, wipe portion switching means with respect to the nozzle plate 5 is realized.

After its cutting, the wipe member 7 is moved down such that the height of the tip portion of the wipe member 7 becomes lower than the nozzle plate 5 (Step S28). The wipe member moving means 11 is driven (Step S29) until it is determined based on a change in the output from the wipe member home position sensor 301 that the wipe support member 8 has been moved to its home position (N in Step S30).

When it is determined based on the change in the output from the wipe member home position sensor 301 that the wipe support member 8 has been moved to the home position (Y in Step S30), the driving of the wipe member moving means 11 is stopped (Step S31), and the counter and timer are cleared (Step S32). The above-described operation flowchart was shown in FIG. 8.

Thus, the tip of the wipe member 7 at which sweeping capability is degraded due to abrasion and adhesion of foreign matters or particles, is removed and hence a new tip is produced. Therefore, the capability of sweeping by the maintenance means 3 can be restored in a manner similar to the initial state. According to the present embodiment, satisfactory capability of sweeping by the maintenance means 3 can be ensured over a long period with suitable execution of the switching operation.

Owing to the execution of the switching operation with, for example, timing at which a predetermined number of maintenance operations are performed, timing at which no maintenance operation is performed, or timing at which execution is instructed by a key operation or the like made by an operator, the wipe member 7 is not cut more than necessary each time the maintenance operation is done, for example. Consequently, the capability of sweeping by the maintenance means 3 can be maintained over a longer period.

Figure 9A:
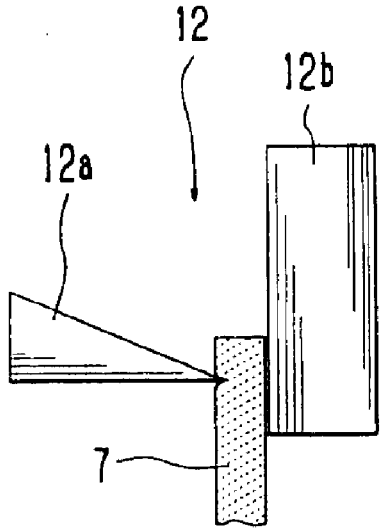
FIG. 9A is an explanatory view showing a cut initial state in which the tip of a blade is abutted against the corresponding wipe member upon cutting of the wipe member.
Figure 9B:
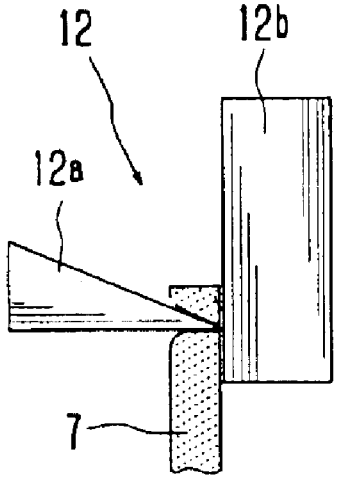
FIG. 9B is an explanatory view illustrating a cut intermediate state in which the tip of the blade is abutted against a receiving table upon cutting of the wipe member.

On the other hand, since the wipe member 7 is formed of the elastic material, a portion thereof brought into contact with the blade portion 12*a* is pressed by its own elasticity and thereby brought into an extended (recessed) state in a cutting initial stage at which the tip of the blade portion 12*a* is brought into contact with the wipe member 7 upon cutting (see FIG. 9A). Then, its extension is cut when it goes beyond a limit based on its own elasticity (see FIG. 9B).

Figure 9C:
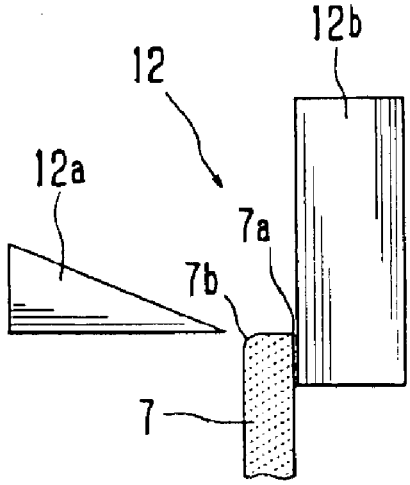
FIG. 9C is an explanatory view showing a cut completion state in which the tip of the blade is separated from the receiving table upon cutting of the wipe member.

Therefore, the shape of the tip of the post-cut wipe member 7 is brought to such a state that the receiving table 12*b* side is made squarish and the blade portion side taken as the cutting early side is assumed to be slightly roundish, as shown in FIG. 9C. Assuming that such a squarish portion is used as an edge portion 7*a* and the slightly roundish portion is used as a corner arcuate portion 7*b*, the contact of the edge portion 7*a* with the nozzle plate 5 rather than the contact of the corner arcuate portion 7*b* with the nozzle plate 5 brings about a large effect upon the maintenance operation using the wipe member 7 having such a tip shape in terms of removal of the remaining inks.

Since the direction of movement of the blade portion 12*a* at its cutting is set so as to be identical to the sweeping direction in the present embodiment, the edge portion 7*a* can always be abutted against the nozzle plate 5 upon the maintenance operation. It is thus possible to satisfactorily maintain the capability of sweeping by the maintenance means 3.

Incidentally, while the sweeping direction is set so as to extend from the left to right in the present embodiment, no limitation is imposed on it. The sweeping direction may be set to extend from the right to left in FIG. 2, for example. Since, in this case, the direction of the movement of the blade portion 12*a* at its cutting is set as the sweeping direction in the wipe member cutting mechanism 12, the blade portion 12*a* is disposed so as to be located in the direction to detach from the nozzle plate 5 rather than from the receiving table 12*b* according to the direction of sweeping by the wipe member 7.

Since the wipe support member 8 can be detached from the main body of the apparatus together with the wipe member 7, the cartridge portion can be replaced by another where the wipe member 7 is used up to a position where it can be paid out. Thus, satisfactory capability of sweeping by the maintenance means 3 can be ensured over a longer period.

On the other hand, the wipe member 7 in the maintenance means 3 is not necessarily limited to the above-described shape wound in the roll form. The maintenance means 3 having such a construction as shown in FIG. 10, for example, may be adopted.

Figure 10:
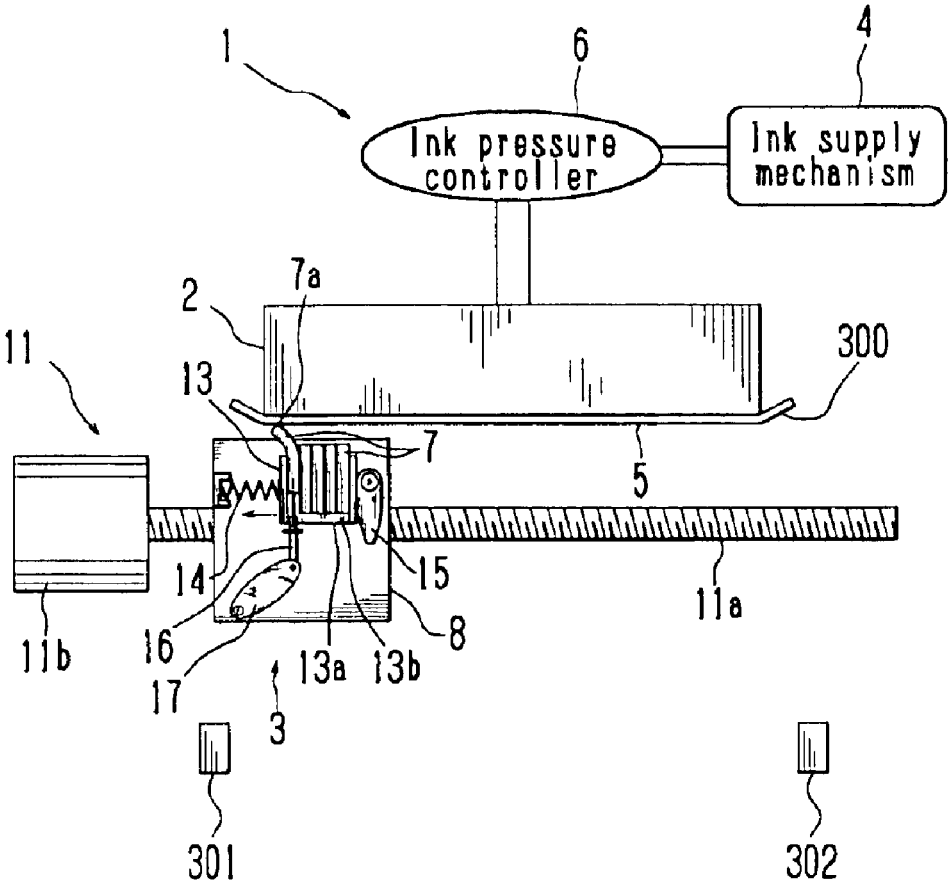
FIG. 10 is a schematic diagram illustrating an ink jet recording apparatus having a maintenance means for cleaning an another ink jet recording head, according to the present invention.

The maintenance means 3 shown in FIG. 10 is provided with a plurality of wipe members 7 each formed of an elastic body in a plate form. Tips of the respective wipe members 7 serve as wipe portions respectively. The wipe portions include edge portions 7*a* extending along the direction intersecting the direction of movement of a wipe support member 8. The respective wipe members 7 are held or accommodated within a wipe storage box 13 in a state in which they are laminated along the direction of the movement of the wipe support member 8. The wipe storage box 13 is supported so as to be movable along the direction of lamination of the wipe members 7 with respect to the wipe support member 8. The wipe storage box 13 is urged from the left to right in FIG. 10 by a spring 14 and thereby brought into contact with a cam 15 provided in the wipe support member 8 in FIG. 10. The cam 15 is rotatably driven by a controller 109.

A hole 13*b* for allowing a pressing member 16 provided for the wipe support member 8 to be inserted is provided at a bottom face 13*a* of the wipe storage box 13. The hole 13*b* is formed such that the respective wipe members can be pressed from below by means of the pressing member 16. In the present embodiment, the respective wipe members 7 are moved along the direction of their lamination with respect to the pressing member 16 to thereby make it possible to replace the corresponding wipe member 7 abutted against the nozzle plate 5. Incidentally, although not shown in the drawing, the pressing members 16 may be respectively provided on the sides below the respective wipe members 7, for example.

The pressing member 16 is provided so as to be capable of appearing in a vertical direction in FIG. 10 and has such a configuration as to be capable of being inserted into the hole 13*b* defined in the wipe storage box 13 and being pulled out of the bottom face 13*a* side. The pressing member 16 is coupled to a cam 17 provided rotatably with respect to the wipe support member 8. The cam 17 is rotatably driven by the controller 109 to allow the pressing member 16 to appear. Such a pressing member 16 is capable of pressing the tip of the selectively-extruded wipe member 7 so as to abut against the nozzle plate 5. Subsequently, the positions of the wipe members 7 stored in the wipe storage box 13 are defined as their storage positions, and the position of the corresponding wipe member 7 which is extruded from the wipe storage box 13 by the pressing member 16 and abutted against the nozzle plate 5, is defined as a press position. Here, the wipe storage box 13, hole 13*b*, spring 14, cam 15, pressing member 16, cam 17 and wipe support member 8 realize a mechanism for supporting the wipe member 7.

In addition, the wipe storage box 13 serves as a cartridge and is supported detachably with respect to the wipe support member 8. Incidentally, while the wipe storage box 13 is detachable in the present embodiment, the present invention is not limited to it. The wipe support member 8 may be detachably provided in a manner similar to the above-described embodiment.

Figure 12:
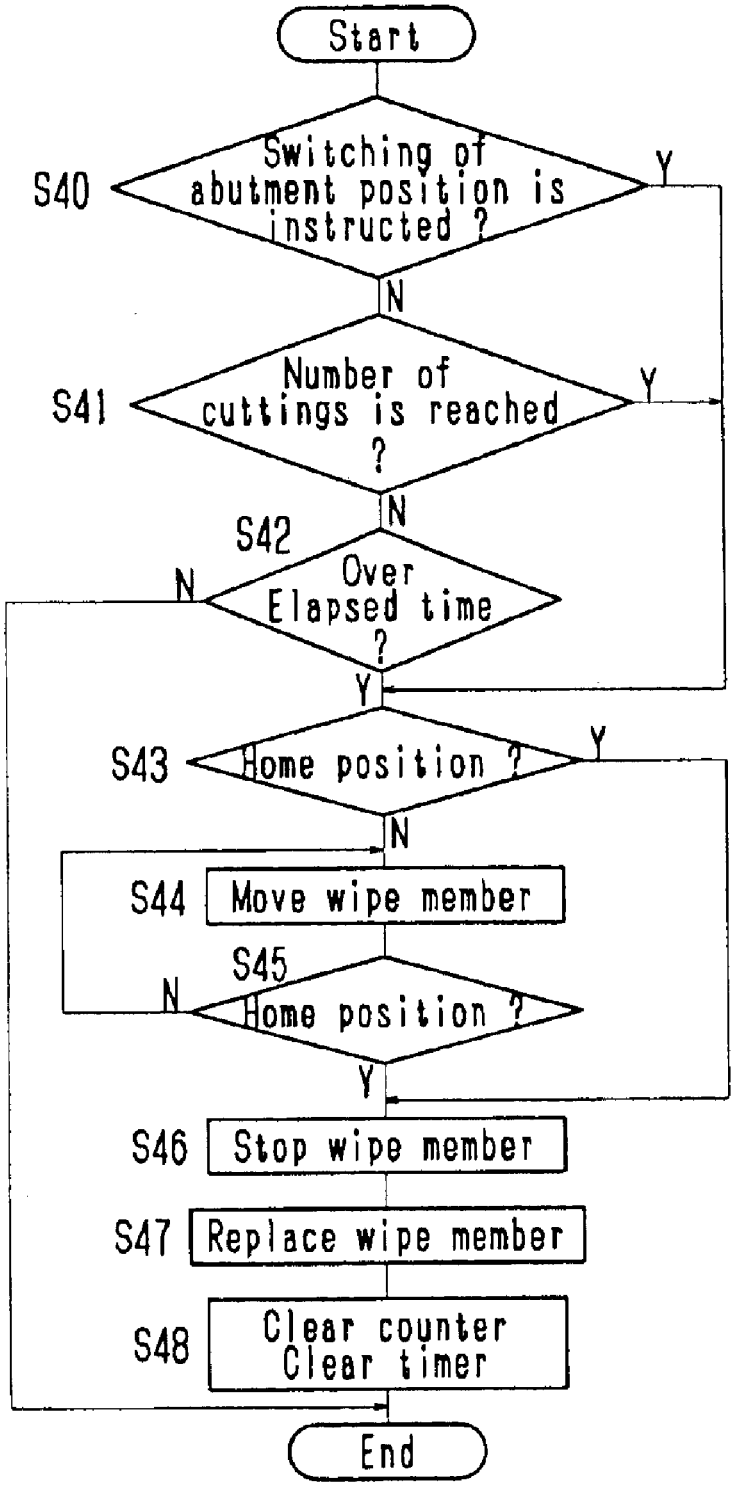
FIG. 12 is a flowchart for schematically describing another switching operation.

A description will now be made of a switching operation executed in an ink jet recording apparatus 1 equipped with such a maintenance means (see FIG. 12). Incidentally, since the maintenance operation is similar to FIG. 6, the description thereof is omitted.

Figure 8:
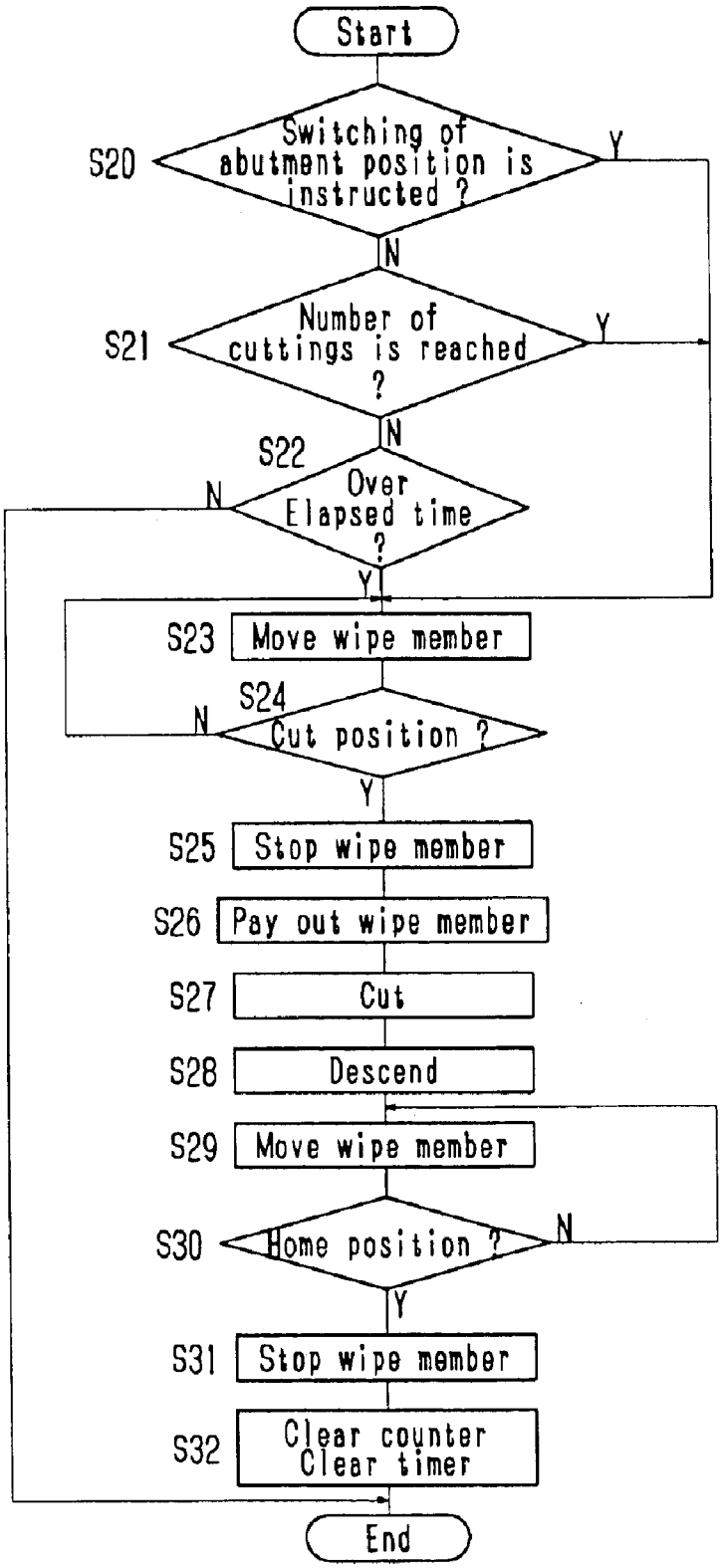
FIG. 8 is a flowchart for schematically describing a switching operation for the ink jet recording apparatus of the present invention.

When it is determined that the execution of the switching operation has been declared due to the aforementioned various factors (Y in Step S40, Y in Step S41 or Y in Step S42) during standby of the declaration of execution of the switching operation (N in Step S40, N in Step S41 and N in Step S42) in a manner similar to FIG. 8, it is determined, based on a change in the output from a wipe member home position sensor 301, whether the wipe support member 8 is placed in its home position (Step S43).

When it is determined based on the change in the output from the wipe member home position sensor 301 that the wipe support member 8 is not placed in the home position (N in Step S43), wipe member moving means 11 is driven (Step S44) until it is determined based on the change in the output from the wipe member home position sensor 301 that the wipe support member 8 has been moved to the home position (N in Step S45).

When it is determined based on the change in the output from the wipe member home position sensor 301 that the wipe support member 8 has been moved to the home position (Y in Step S45), the driving of the wipe member moving means 11 is stopped (Step 546) and the corresponding wipe member 7 is replaced by another (Step S47).

In order to replace the wipe member in Step S47 here, the cam is rotated to pull down the pressing member 16, and the cam 15 is rotated by a predetermined angle. Consequently, the wipe member 7 abutted against the nozzle plate 5 at its pressed position by the pressing member 16 is restored to its corresponding storage position. Further, the spring 14 is compressed so that the wipe storage box is moved from right to left in FIG. 10.

At this time, the turning angle of the cam 15 is defined in advance to thereby make it possible to displace the position of the wipe storage box 13 with respect to the wipe support member 8 by the thickness of one sheet of wipe member 7.

Then the pressing member 16 is displaced to a press position again. Thus, the wipe member 7 adjacent to the wipe member 7 just-stored in the storage position is extruded and located in a press position, and then pressed so as to abut against the nozzle plate 5. Here, means for selecting the positions of abutment of the wipe members 7 against the nozzle plate 5 is realized.

Finally, the counter and timer are cleared (Step S48) and processing is ended.

Thus, the capability of sweeping by the maintenance means 3 can be restored in a manner similar to the initial state with no cumbersome wipe-member replacement work. Since the maintenance means 3 is provided with the plurality of wipe members 7, the capability of sweeping by the maintenance means 3 can be ensured over a long period.

Since the wipe storage box 13 is supported detachably with respect to the wipe support member 8, the cartridge portion can be replaced by another where all the wipe members 7 are used up. It is thus possible to ensure satisfactory capability of sweeping by the maintenance means 3 over a longer period.

Namely, the maintenance means 3 for cleaning the ink jet recording head 2, according to the present invention comprises the wipe members 7 each formed of the elastic material and holding the plurality of wipe portions so as to be capable of appearing, the mechanism 8 for supporting the corresponding wipe member 7 so as to bring one wipe portion into contact with the nozzle plate 5 in which the plurality of nozzles 10 communicating with each pressure chamber for holding ink are arranged, the mechanism 11 for moving the mechanism 8 supporting the wipe members 7 along the nozzles 10, and the means for performing switching between the wipe portions abutted against the nozzle plate 5. Therefore, the corresponding wipe member 7 abutted against the nozzle plate 5 is moved along the nozzles 10 to remove ink and foreign particles remaining around the nozzles 10, and the position of abutment of the wipe member 7 against the nozzle plate 5 is suitably selected, whereby satisfactory sweeping capability of the wipe member 7 can be maintained without providing a mechanism for cleaning each wipe member 7, and performing the work of replacing the wipe member 7 with another.

According to the ink jet recording apparatus 1 of the present invention, which is equipped with such a maintenance means 3 for cleaning the ink jet recording head 2, satisfactory delivery performance at print can be maintained.

According to the maintenance means 3 cleaning for the ink jet recording head 2, of the present invention, each of the wipe portions has the edge portion 7*a* extending along the direction intersecting its moving direction, and the mechanism 8 for supporting the wipe member 7 supports the wipe member 7 so as to abut the edge portion 7*a* against the nozzle plate 5. It is therefore possible to enhance capability of sweeping by the wipe member 7 without complicating a configuration.

According to the ink jet recording apparatus 1 of the present invention, which is equipped with such a maintenance means 3 for cleaning the ink jet recording head 2, satisfactory delivery performance at print can be maintained, and reliability at print can be enhanced.

According to the maintenance means 3 for cleaning the ink jet recording head 2, of the present invention, the mechanism 8 for supporting each wipe member 7 supports the wipe member 7 in such a manner that the edge portion 7*a* is urged toward the nozzle plate 5 by the elastic force of the wipe member 7. It is therefore possible to further enhance sweeping capability of the wipe member 7 without complicating a configuration.

According to the ink jet recording apparatus 1 of the present invention, which is provided with such a maintenance means 3 for cleaning the ink jet recording head 2, satisfactory delivery performance at print can be assuredly maintained, and reliability at print can be enhanced.

According to the maintenance means 3 for cleaning the ink jet recording head 2, of the present invention, the wipe member 7 is wound in the roll form, the mechanism 8 for supporting the wipe member 7 abuts the tip of the wipe member 7 against the nozzle plate 5 and supports the tip of the wipe member 7 so as to be capable of paying out the tip thereof, and the means for performing switching of the wipe portion cuts the tip of the wipe member 7 paid or brought out from the mechanism for supporting the wipe member 7, by means of the wipe member cutting mechanism 12 to thereby select the corresponding wipe portion. Therefore, the wipe member 7 having high sweeping capability can be always abutted against the nozzle plate 5, and satisfactory sweeping capability of the wipe member 7 can be maintained over a long period.

According to the ink jet recording apparatus 1 of the present invention, which is equipped with such a maintenance means 3 for cleaning the ink jet recording head 2, satisfactory delivery performance at print can be maintained over a long period.

According to the maintenance means 3 for cleaning the ink jet recording head 2, of the present invention, the mechanism 8 for supporting each wipe member 7 supports the wipe member 7 such that its wipe portion is abutted against the nozzle plate 5 upon only its movement in one direction, and the wipe member cutting mechanism 12 includes the single blade portion 12*a* for cutting the wipe member 7 upon moving the wipe portion in the direction identical to the direction of movement of the wipe member 7 abutted against the nozzle plate 5. Therefore, the edge portion 7*a* can be abutted against the nozzle plate 5 without effecting particular processing on the post-cut wipe member 7, and satisfactory sweeping capability can be provided.

According to the ink jet recording apparatus 1 of the present invention, which is equipped with such a maintenance means 3 for cleaning the ink jet recording head 2, satisfactory delivery performance at print can be maintained over a long period.

According to the maintenance means 3 for cleaning the ink jet recording head 2, of the present invention, the means for selecting the wipe members respectively having the wipe portions and provided in plural form replaces the wipe member 7 whose wipe portion is abutted against the nozzle plate 5 with another to thereby select the corresponding wipe portion. It is therefore possible to always abut the wipe member 7 having high sweeping capability against the nozzle plate 5 and maintain satisfactory sweeping capability of the wipe member 7 over a long period.

According to the ink jet recording apparatus 1 of the present invention, which is equipped with such a maintenance means 3 for cleaning the ink jet recording head 2, satisfactory delivery performance at print can be maintained over a long period.

According to the maintenance means 3 for cleaning the ink jet recording head 2, of the present invention, the means for selecting the abutment position of each wipe member 7 performs switching of the abutment position each time the wipe member 7 is moved a predetermined number of times along the nozzles 10. Therefore, for example, the timing provided to switch the abutment position is suitably set to thereby make it possible to sweep the nozzle plate 5 according to its use state without needlessly selecting the abutment position, whereby satisfactory sweeping capability of the wipe member 7 can be maintained over a longer period.

According to the ink jet recording apparatus 1 of the present invention, which is equipped with such a maintenance means 3 for cleaning the ink jet recording head 2, satisfactory sweeping capability of the wipe member 7 can be maintained over a longer period.

According to the maintenance means 3 for cleaning the ink jet recording head 2, of the present invention, the mechanism 8 for supporting each wipe member 7 is detachable in a state of having supported the wipe member 7. Therefore, the mechanism 8 for supporting the wipe member 7 is detached from the main body of the apparatus, so that only the mechanism for supporting the wipe member 7 or the wipe member 7 can be replaced by another, and hence satisfactory sweeping capability of the wipe member 7 can be maintained over a longer period.

According to the ink jet recording apparatus 1 of the present invention, which is equipped with such a maintenance means 3 for cleaning the ink jet recording head 2, satisfactory sweeping capability of the wipe member 7 can be maintained over a longer period.

A large number of modifications and changes in the present invention can be apparently made in light of the above descriptions. Accordingly, it is understood that the present invention can be also implemented within the scope of the appended claims by embodiments different from ones specifically described herein.

What is claimed is:

1. A maintenance apparatus for cleaning an ink jet recording head, said maintenance apparatus comprising:

a wipe member formed of an elastic material and holding a plurality of wipe portions;

a mechanism for supporting the wipe member such that one of the wipe portions is abutted against a nozzle plate having a plurality of nozzles communicating with a pressure chamber for holding ink;

a mechanism for moving the mechanism for supporting the wipe member along the nozzles; and means for switching the wipe portion abutted against the nozzle plate, wherein the wine member is wound in a roll, wherein the mechanism for supporting the wipe member supports the wipe member such that a tip of the wipe member is adapted to abut against the nozzle plate and supports the tip of the wipe member such that the mechanism for supporting the wipe member is adapted to pay out the tip of the wipe member, and wherein the means for switching the wipe portion switches the wipe portion by cutting the tip of the wipe member paid out from the wipe member supporting mechanism with a wipe member cutting mechanism.

2. The maintenance apparatus according to claim 1, wherein each of the wipe portions has an edge portion extending along a direction intersecting a moving direction of the mechanism for supporting the wipe member, and wherein the mechanism for supporting the wipe member supports the wipe member such that the edge portion is adapted to abut against the nozzle plate.

3. The maintenance apparatus according to claim 1, wherein the mechanism for supporting the wipe member supports the wipe member such that the edge portion is urged toward the nozzle plate by an elastic force of the wipe member.

4. The maintenance apparatus according to claim 1, wherein the mechanism for supporting the wipe member supports the wipe member so as to allow the wipe portion to abut against the nozzle plate only upon movement thereof in one direction, and the wipe member cutting mechanism includes a single blade portion for cutting the wipe member when the wipe portion is moved in a direction identical to the direction of movement of the wipe member abutted against the nozzle plate.

5. The maintenance apparatus according to claim 1, wherein the means for switching the wipe portions switches the wipe portion each time the wipe portion moves along the nozzles a predetermined number of times.

6. The maintenance apparatus according to claim 1, wherein the mechanism for supporting the wipe member is detachable.

7. An ink jet recording apparatus comprising:

a pressure chamber for holding ink;

a nozzle plate having a plurality of nozzles which communicate with the pressure chamber; and a maintenance apparatus for an ink jet recording head, said maintenance apparatus comprising:

a wipe member formed of an elastic material and holding a plurality of wipe portions;

a mechanism for supporting the wipe member such that one of the wipe portions is adapted to abut against the nozzle plate having the plurality of nozzles;

a mechanism for moving the mechanism for supporting the wipe member along the nozzles; and means for switching the wipe portion abutted against the nozzle plate, wherein the wipe member is wound in a roll, wherein the mechanism for supporting the wipe member supports the wipe member such that a tip of the wipe member is adapted to abut against the nozzle plate and supports the tip of the wipe member such that the mechanism for supporting the wipe member is adapted to pay out the tip of the wipe member, and wherein the means for switching the wipe portions switches the wipe portion by cutting the tip of the wipe member paid out from the wipe member supporting mechanism with a wipe member cutting mechanism.

8. The ink jet recording apparatus according to claim 7, wherein each of the wipe portions has an edge portion extending along a direction intersecting a moving direction of the mechanism for supporting the wipe member, and wherein the mechanism for supporting the wipe member supports the wipe member such that the edge portion is adapted to abut against the nozzle plate.

9. The ink jet recording apparatus according to claim 8, wherein the mechanism for supporting the wipe member supports the wipe member such that the edge portion is urged toward the nozzle plate by an elastic force of the wipe member.

10. The ink jet recording apparatus according to claim 7, wherein the mechanism for supporting the wipe member supports the wipe member such that the wipe portion is adapted to abut against the nozzle plate only upon movement thereof in one direction, and wherein the wipe member cutting mechanism includes a single blade portion for cutting the wipe member when the wipe portion is moved in a direction identical to a direction of movement of the wipe member abutted against the nozzle plate.

11. The ink jet recording apparatus according to claim 7, wherein the means for switching the wipe portions switches the wipe portion each time the wipe member moves along the nozzles a predetermined number of times.

12. The ink jet recording apparatus according to claim 7, wherein the mechanism for supporting the wipe member is detachable.

* * * * *